US009809423B2

(12) United States Patent
Santos

(10) Patent No.: US 9,809,423 B2
(45) Date of Patent: Nov. 7, 2017

(54) BASE FOR AN ELEVATOR CAR

(75) Inventor: Agnaldo Santos, São Paulo (BR)

(73) Assignee: INVENTIO AG, Hergiswil (CH)

( * ) Notice: Subject to any disclaimer, the term of this patent is extended or adjusted under 35 U.S.C. 154(b) by 304 days.

(21) Appl. No.: 14/236,918

(22) PCT Filed: Aug. 25, 2011

(86) PCT No.: PCT/EP2011/064651

§ 371 (c)(1),
(2), (4) Date: Feb. 4, 2014

(87) PCT Pub. No.: WO2013/026489

PCT Pub. Date: Feb. 28, 2013

(65) Prior Publication Data

US 2014/0158472 A1 Jun. 12, 2014

(51) Int. Cl.
*B66B 11/02* (2006.01)

(52) U.S. Cl.
CPC ..... *B66B 11/0226* (2013.01)

(58) Field of Classification Search
CPC ..... B66B 11/0226
USPC ..... 187/343, 401; 52/793.1
See application file for complete search history.

(56) References Cited

U.S. PATENT DOCUMENTS 4,414,257 A * 11/1983 Haraga ..... B32B 3/28 428/182
4,557,961 A * 12/1985 Gorges ..... B32B 3/12 428/117
5,612,117 A * 3/1997 Belanger ..... E04C 2/326 428/118
7,575,650 B1 * 8/2009 Shah ..... B32B 3/12 156/290
2011/0017106 A1 1/2011 Muirhead
2011/0073018 A1 3/2011 Apps
2012/0255811 A1 * 10/2012 Wuest ..... B66B 11/0226 187/343

FOREIGN PATENT DOCUMENTS

| | | | | |
|---|---|---|---|---|
| CA | 2290150 | A1 | 5/2000 | |
| DE | 10008848 | A1 | 8/2001 | |
| DE | 102009041436 | A1 | 3/2011 | |
| EP | 0566424 | B1 * | 2/1997 | ..... B66B 11/0226 |
| EP | 1004538 | B1 | 11/1999 | |
| JP | 6100274 | A | 4/1994 | |
| JP | 8113445 | A | 5/1996 | |
| JP | 2005263427 | A | 9/2005 | |
| JP | 2008001461 | A | 1/2008 | |
| JP | 2010228880 | A * | 10/2010 | |
| WO | 2006026872 | A2 | 3/2006 | |

OTHER PUBLICATIONS

English Machine Translation of JP 08-113445.*
English Machine Translation of JP 2010-228880.*
English Machine Translation of EP 0 566 424.*

* cited by examiner

*Primary Examiner* — William E Dondero
*Assistant Examiner* — Diem Tran
(74) *Attorney, Agent, or Firm* — William J. Clemens; Shumaker, Loop & Kendrick, LLC

(57) ABSTRACT

An elevator car includes a floor base, which is stiff in bending, with a metallic base structure in which a support element of plastics material is arranged. The support element is formed as an integral mold body and is produced by means of an injection-molding method.

16 Claims, 4 Drawing Sheets

BASE FOR AN ELEVATOR CAR

FIELD

The invention relates to a floor base for an elevator car. In addition, the invention relates to an elevator with an elevator car including such a floor base.

BACKGROUND

Elevator cars are installed in, for example, car frames which in turn are guided by rails fastened in elevator shafts and are moved up and down by drive engines by way of wire cables or other support means. Car floors, which are stiff in bending or stable relative to other mechanical actions, can be constructed in composite structure or sandwich mode of construction. A 'sandwich' floor of that kind has become known from, for example, EP 1 004 538 B1. The floor consists substantially of two mutually spaced-apart steel plates of a base structure, between which a support structure is arranged. The support structure is composed of a plurality of mutually crossing flat sections which form a grating-like composite structure. In practice it has proved that this floor stiff in bending does indeed withstand very high mechanical loads, but is comparatively costly and heavy.

SUMMARY

It is accordingly an object of the present invention to avoid the disadvantages of the prior art and, in particular, to create a floor base of the kind stated in introduction which can be produced simply and economically. Moreover, the floor base shall be distinguished by a low weight.

The floor base, which is stiff in bending, according to the invention has a preferably metallic base structure, in which a base plate for predetermining a standing surface for passengers is fastenable or fastened. A support structure consisting substantially of a non-metallic material is arranged in the base structure. Through the use of non-metallic materials the overall weight for the elevator car can be substantially reduced. The floor base can—similarly as in the previously mentioned EP 1 004 538 B1—have a flat underside and a flat upper side arranged at a spacing from the underside, wherein the support structure can be arranged or received in, for example, sandwich-like manner between upper side and underside. For example, four side wall sections by which the floor base is closed can be connected with the preferably metallic plates for the upper side and underside at right angles. Upper side and underside as well as the side wall sections can be made from plates of steel sheet metal. Obviously, apart from the afore-described block-shaped structure with upper side and lower side as well as the four side wall sections, other shapes and modes of construction for base structures for fixing the support structure are also conceivable. For example, the base could be gripped in a metal frame or in a framework structure.

In a first form of embodiment the support structure can consist of a plastics material, a plastics material laminate or a material based on wood. Combinations of the mentioned materials are also embraced by the invention. The materials can in addition be mixed with reinforcements or have reinforcements. Thus, the support structure could consist of, for example, a fiber-reinforced plastics material. Coming into question as materials based on wood are wood, plywood, laminated wood, particleboards, fiberboards and composite materials. The support structure does not necessarily have to completely consist of the mentioned materials. For example, constructed support structures of wood could also include metallic fastening means such as nails, screws, etc. In this construction, costs and weight for the floor base can be reduced in simple mode and manner.

It can be advantageous for simple handling and capability of manufacture if the support structure comprises a single support element or several support elements disposed adjacent to one another. In that case, the one support element or the support elements disposed adjacent to one another can occupy substantially the entire floor area. For certain applications even support structures covering mere sub-regions would also be conceivable; for example, the support element could occupy merely half the floor area in plan view.

The support structure can comprise at least one integrally formed support element. This support element can be prefabricated and then incorporated in the base in a few working steps. The integral support element can be of monolithic construction and be created by means of, for example, a reshaping, pressing and/or molding method. Plastics material support structures can, for example, in the case of use of suitable plastics materials (for example, thermoplastic plastics material such as PP, PU, PE, etc.), be produced particularly simply in an injection-molding method. However, it is also conceivable to use for the support structures area blanks or plastics material plates which are plastically brought into the desired shape (reshaping). The monolithic molded body could also consist of press-molded and glued particleboards.

With particular preference the support element can have an areal floor section at which projections are formed or fastened. The projections can bridge over the spacing between the upper side and underside of the floor base, which has an advantageous effect on the weight and the stability of the floor base. The projections can preferably be components, which are integrated together with the floor section, of a monolithic moulded body. Instead of projections formed in place, the projections can, however, also consist of separate components which are connected with the floor section by suitable fastening elements.

The afore-mentioned projections can be formed as, for example, stand feet which in plan view are preferably distributed uniformly on the floor section area and would be supportable on an even underlay.

With particular advantage the projections are formed to be beaker-shaped, whereby support elements can be stacked prior to installation in the floor base. In this manner, these semi-finished products can be stored and transported in simple and advantageous manner. Moreover, advantageous cavities arise in the constructed state thanks to the projections and the overall weight for the car floor base can be further reduced.

The beaker-shaped projections can have conically extending, lateral support wall sections. A support floor section, which preferably extends planoparallelly to the floor section, is connected with the support wall section or respective support wall sections of a projection.

Alternatively to the afore-described stand feet, the support element can also be provided with runners. For example, the support element could have a center and two side runners. The runners could in that case respectively comprise flat sections which were connected with the floor section by way of spacer elements.

The floor section can be of plate-shaped construction. The plate can have interruptions for further reduction in weight. The interruptions can, for example, be rectangular or form a honeycomb structure in plan view.

The floor section can have a surface which preferably extends planoparallely to the standing area for the passengers. The standing area could theoretically also be formed by the floor section itself. In this case the passengers of an elevator would thus stand directly on the support element.

The beaker-shaped projections, which are open on one side and have a supporting floor section on the opposite side, can be formed on or fastened to the floor section in such a manner that the open side of the projections is connected with the floor section and thus permits simple stacking of several support bodies one on the other.

The base structure can be formed as a framework. A further weight reduction can be achieved with this variant. However, other design possibilities are obviously also conceivable. Thus, the base structure could, for very high static and dynamic demands, be selected to be a solidly constructed steel construction. Moreover, the base structure can, for example, be constructed as a mounting frame laterally embracing the support structure.

In a further form of embodiment the floor base can have a base structure with longitudinal girders extending in longitudinal direction and transverse girders extending at right angles to the longitudinal girders, the girders being connected together.

The support structure can be connected with the base structure in shape-locking and/or force-locking manner. However, for fixing the support structure on the base structure use can also be made of fastening means such as, for example, screw connections. It would also be conceivable to fix the support structure in the base structure by an adhesive connection.

The base structure can in cross-section include U-shaped rail sections with depressions which are complementary with the projections and in which the projections are received for positional fixing of the support element in the floor base. The depressions can be formed as guide channels extending in longitudinal direction. This design has, in particular, also advantages in terms of production engineering, since the support structure can be introduced in simple manner and then displaced in longitudinal direction along the guide channels. The rail sections can be fastened in simple manner in or to the base structure. Instead of separate components of that kind the depressions could also be formed as guide grooves, which could be an integral component of the underside of the floor of the car of the elevator. As an alternative to the channel-like depressions, however, individual depressions could also be provided, which enable reception of the projections to be a precise fit all round.

A second aspect of the invention relates to a floor base for an elevator car in which, for reinforcement of the floor, a support structure is integrated, wherein the support structure includes at least pallet provided for supporting and transporting goods. The objects mentioned in the introduction are thus also fulfilled by the floor base, which is described here, with the pallet. The pallet can form the previously described support element. The pallets, also generally known under the designation 'load carrier', are widespread and customary in the transport industry. Goods are to a wide extent loaded and transported on such pallets in trucks, trains, aircraft or ships. The pallets are designed so that they can be moved in simple manner by means of, for example, lifting trucks or forklifts. Unexpectedly, it has proved that such pallets can also be used in the elevator industry. Through the use of pallets in car floors costs can be considerably reduced, particularly if use is made of commercially available pallets. Depending on the respective form of the floor the pallets can be used unchanged or if required with small adaptations. Tests have shown that car floors of that kind can also fulfil the demands with respect to stiffness and stability in many fields of use.

Pallets can consist of different materials, wherein wood pallets (for example, instead of many: 'Euro-pallet or EUR-pallet) are very widespread. However, it is particularly advantageous if the support structure includes at least one plastics material pallet. Plastics material pallets have, apart from the low weight, also the advantage that they are available in innumerable sizes and shapes and nevertheless sufficiently withstand mechanical loads. Plastics material pallets with stand feet are described in, for example, DE 10 2009 041 436 A1. However, plastics material pallets with runners in the manner of classic wood pallets could also be used. A pallet of that kind has become known from, for example, US 2003/0110990 A1.

DESCRIPTION OF THE DRAWINGS

Further individual features and advantages of the invention are evident from the following description of exemplifying embodiments and from the drawings, in which.

DETAILED DESCRIPTION

Figure 1:
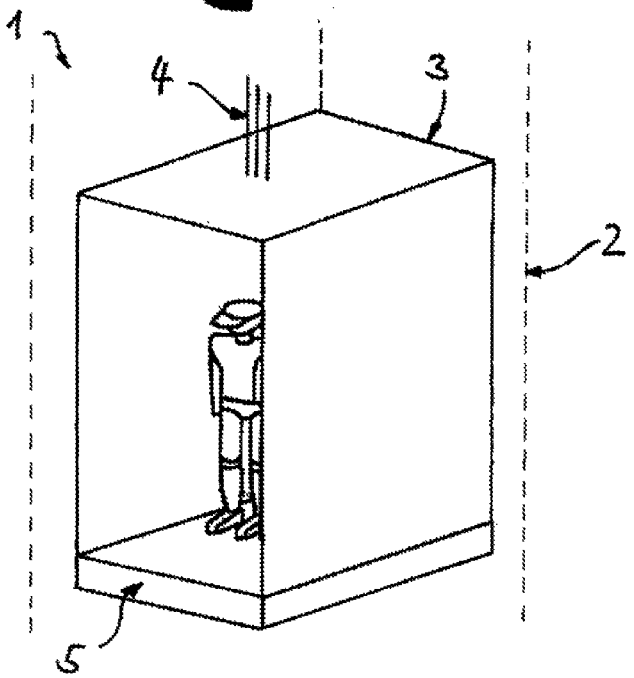
FIG. 1 shows a substantially simplified perspective illustration of an elevator car with a car floor base according to the invention.

FIG. 1 shows an elevator, which is denoted overall by 1, with a car 3 fastened to support means 4. The shaft is indicated by dashed lines 2. Such or similar elevators have been known for a long time and are conventional. Instead of the support cables 4 shown by way of example in the exemplifying embodiment according to FIG. 1 other support means such as, for example, individual or multiple support bands or belts of different materials and compositions also come into question. The elevator comprises a car floor base 5 which is particularly stiff in bending. The composition and construction of the elevator car are described in detail on the following on the basis of FIGS. 2 to 12.

Figure 2:
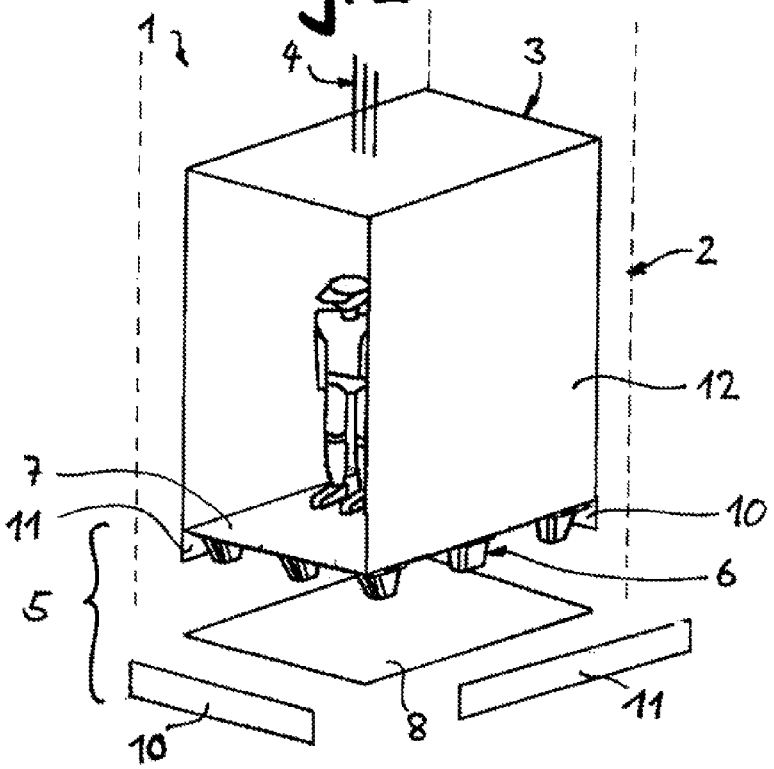
FIG. 2 shows the car of FIG. 1 with a floor base in partly exploded illustration.

As evident from FIG. 2, an individual support element 6 as a support structure is arranged in the floor base 5. Also evident in FIG. 2 is an underside 8, which is formed as a plate and on which the support element 6 is supported. The base 5 is closed laterally by four side wall sections 10, 11. The support element 6 is included in a substantially blocked-shaped base structure. The underside plate 8 can consist of steel; similarly, the four side wall sections 10 and 11 can be made of a steel plate. The support surface of the passengers is formed predominately by a floor plate denoted by 7. The side wall sections 10 and 11 for the floor base 5 flushly adjoin, as is apparent, the respective side wall 12.

Figure 3:
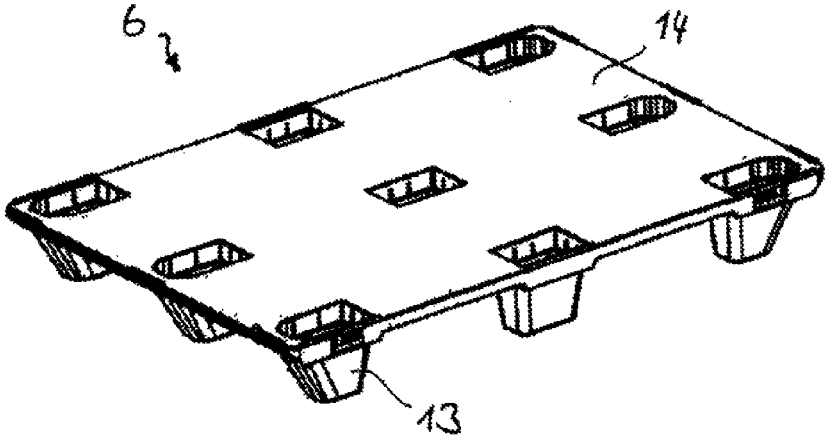
FIG. 3 shows a perspective illustration of a support element for the floor base shown in FIG. 2.

FIG. 3 shows a perspective illustration of the support element 6 for the elevator car floor base. The support element 6 has a flat floor section 14 and nine projections 13 formed thereon. This support element is formed as an integral molded body. Such a support structure can be produced from different plastics material, but preferably thermoplastic plastics materials (for example, PU, PP, PE). In the present exemplifying embodiment according to FIG. 3 the support body 6 is a plastics material pallet of the kind such as has become known from, for example, DE 10 2009 041 436 A1 or US 2007/0056483 A1. The parts 13, here designated in general as projections, represent stand feet. The stand feet 13 are arranged in three rows extending in longitudinal and transverse direction. The stand feet 13 make it possible for a fork (not illustrated here) of, for example, a forklift or lifting truck to be insertable below the floor section 14 and the pallet to be able to be lifted. The projections or support feet 13 are of beaker-shaped construction. The projections 13 are connected with corresponding openings in the floor section 14. Plastics material pallets of that kind can thus be stacked in simple manner.

Figure 4:
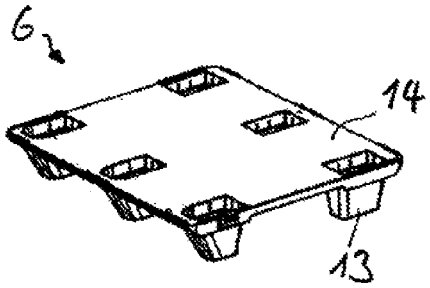
FIG. 4 shows a support element, which is modified in relation to the exemplifying embodiment according to FIG. 3, in slightly reduced-scale illustration.

Plastics material parts can be produced in simple mode and manner in, for example, an injection-molding method or by thermal reshaping. Pallets are economically available in diverse standardized sizes in commerce. For smaller elevator cars the pallets can be reduced in size by means of cutting or other processing methods. A support body 6 of that kind reduced in size is shown in FIG. 4, which is evident from the pallet of FIG. 3.

Figure 5:
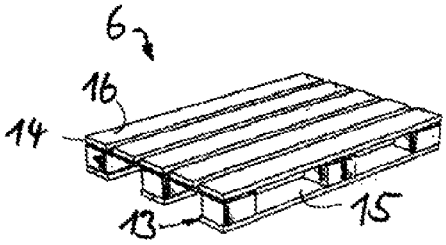
FIG. 5 shows an alternative support element.
Figure 6:
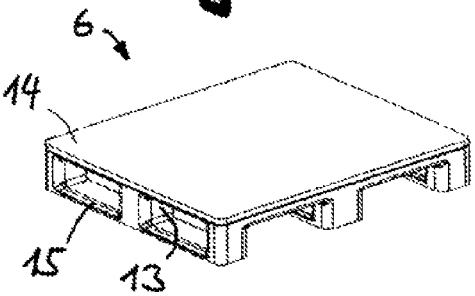
FIG. 6 shows a further support element for a car floor base.
Figure 7:
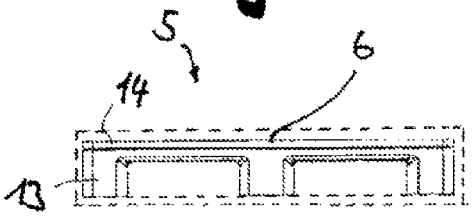
FIG. 7 shows the support element of FIG. 6 in a side view.

In principle, other pallets or load supports could also be used as the support structure for the car floor base of an elevator car. For example, a wood pallet known under the designation 'Europalett' could be integrated in a car floor base (FIG. 5). The classic wood pallet has, instead of individual stand feet, three runners 15 extending in longitudinal direction. The runners 15 are formed by wooden boards which are connected by way of spacer elements with the floor section 14 similarly formed by wooden boards. However, pallets having runners can also, as shown in FIGS. 6 and 7, be formed as plastics material products. A plastics material pallet of that kind has become known in, for example, US 2003/0110990 A1. The base structure of a car floor base in which the plastics material pallet 6 is included is indicated in FIG. 7 by dashed lines.

Figure 8:
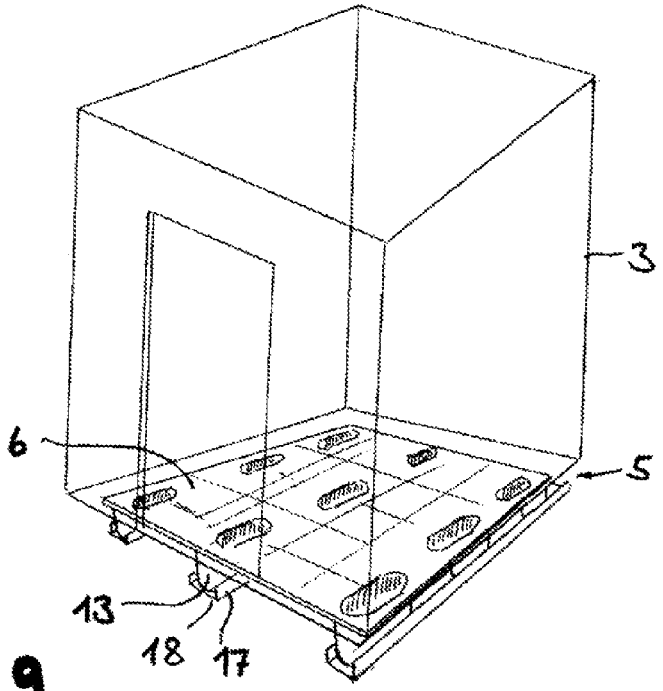
FIG. 8 shows a simplified perspective illustration of a support element for the floor base shown in FIG. 2.

A further example for a floor base 5 of the elevator car 3 is illustrated in FIG. 8. A plastics material pallet 5, which has several stand feet 13, is similarly used for the support structure. The support body 6 is arranged in the base structure with girders 18 and 19 extending in longitudinal and transverse direction. For a stable and stiff floor base the respective three transverse and longitudinal girders 18, 19 are positioned in such a manner that the stand feet 13 are supported on the girders 18, 19. As especially evident from the enlarged detail view in FIG. 10, the longitudinal girders 18 can be formed as U-shaped profile rails 17.

Figure 9:
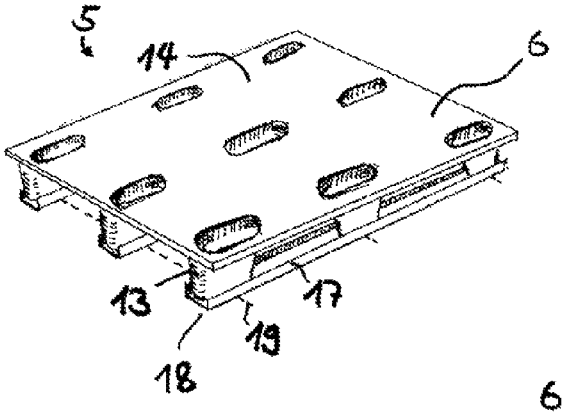
FIG. 9 shows a perspective illustration of a further support element.
Figure 10:
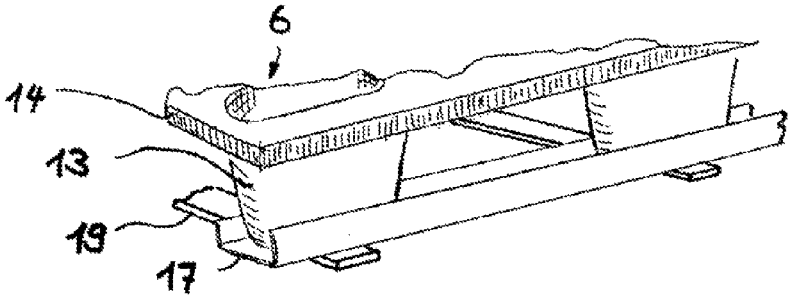
FIG. 10 shows a cross-sectional illustration of a car floor base with the support element of FIG. 9.

Moreover, it can be advantageous to use corresponding means or devices for the fixation of the support structure. FIGS. 9 and 10 show, by way of example, how the support elements can be fixed in terms of position in the floor base. Each respective longitudinal row of stand feet 13 is received in a respective profile rail 17. The three profile rails 17 can in turn be connected with the transverse girders by, for example, a weld connection or with use of other fastening means. The respective transverse girders 19 are indicated in FIG. 9 by dashed lines. The profile rail 17 or the transverse girder 19 as well as the longitudinal girder 18 can be made from, for example, steel.

Figure 11:
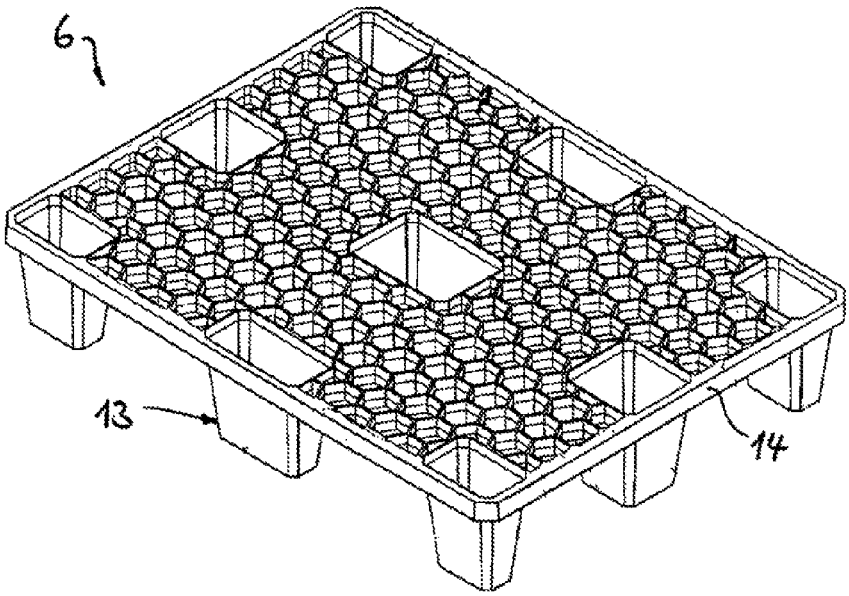
FIG. 11 shows an alternative support element and FIG. 12 shows a side view of a floor base with the support element of FIG. 11.
Figure 12:
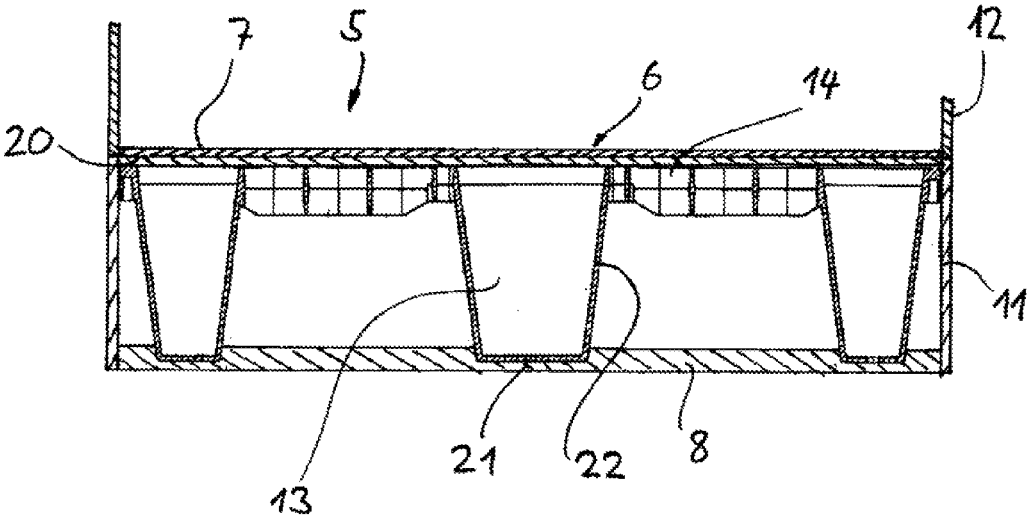

A further variant for a plastics material pallet is shown in FIG. 11. This pallet differs from the preceding exemplifying embodiment substantially merely by the fact that the floor section 14 has specially shaped interruptions which form a honeycomb structure. The floor section 14 has a plurality of interruptions which lead to a further weight reduction. Of course, other configurations are also conceivable. For example, the interruptions can be rectangular in plan view. FIG. 12 shows an example of how the plastics material pallet 16 of FIG. 11 can be incorporated in a car floor base. The base structure of the car floor base 5 comprises an underside 8 which is formed as a plate and in which guide grooves for reception of the stand feet 13 are arranged. As FIG. 12 additionally clearly shows, the stand feet have conically extending support wall sections 22. The beaker-shaped stand feet 13 are closed by a support floor section 21 extending planoparallely to the support surface. A cover plate 20 is disposed on the opposite side. The support element 6 is thus surrounded at all sides by the base structure. A base plate 7 is placed over the, preferably, metallic cover plate for an optically advantageous appearance, which base plate ultimately defines the support surface. This base plate 7 can consist of the most diverse materials such as, for example, marble, a laminate or plastics material.

In accordance with the provisions of the patent statutes, the present invention has been described in what is considered to represent its preferred embodiment. However, it should be noted that the invention can be practiced otherwise than as specifically illustrated and described without departing from its spirit or scope.

The invention claimed is:

1. A base for an elevator car comprising:

a metallic floor plate forming a passenger support surface; and a support structure formed substantially of a non-metallic material, the support structure supporting an underside of the metallic floor plate, wherein the support structure has a floor section at which a plurality of projections is formed or fastened and each of the projections is formed as beaker-shaped with an opening facing the underside of the metallic floor plate, an area of the floor section being greater than an area of the openings.

2. The base according to claim 1 wherein the support structure is formed of a plastics material or a wood-based material.

3. The base according to claim 1 wherein the support structure extends substantially over an entire floor area of the metallic floor plate.

4. The base according to claim 1 wherein the support structure includes at least one prefabricated support structure formed as an integral molded body.

5. The base according to claim 1 wherein the support structure has a floor section at which six to nine projections are formed or fastened and the projections are formed as beaker-shaped.

6. The base according to claim 1 wherein the the plurality of projections has at least one conically formed lateral support wall section.

7. The base according to claim 1 further comprising a plurality of sidewall sections and an underside plate.

8. The base according to claim 1 wherein the support structure includes a longitudinal girder extending in a longitudinal direction and a transverse girder extending at right angles to the longitudinal girder, the longitudinal girder and the transverse girder being connected together.

9. The base according to claim 1 including U-shaped profile rails or guide grooves in an underside plate which are complementary with projections on the support structure and in which the projections are received for positional fixing of the support structure.

10. The base according to claim 1, wherein the plurality of projections is arranged in a plurality of rows extending in a longitudinal direction of the support structure and a plurality of rows extending in a transverse direction of the support structure.

11. The base according to claim 1, wherein the support structure is configured as a stackable pallet.

12. The base according to claim 11, wherein the plurality of projections of the support structure is configured to be disposed within openings of another support structure when the support structure is stacked onto the another support structure.

13. An elevator having an elevator car, the car comprising: a base including a metallic floor plate forming a passenger support surface and supported by a support structure formed substantially of a non-metallic material, the support structure supporting an underside of the metallic floor plate, wherein the support structure has a floor section at which a plurality of projections is formed or fastened and each of the projections is formed as beaker-shaped with an opening facing the underside of the metallic floor plate, an area of the floor section being greater than an area of the openings, and an underside plate supporting the support structure.

14. The elevator according to claim 13, wherein the plurality of projections is arranged in a plurality of rows extending in a longitudinal direction of the support structure and a plurality of rows extending in a transverse direction of the support structure.

15. The base according to claim 13, wherein the support structure is configured as a stackable pallet.

16. The elevator according to claim 15, wherein the plurality of projections of the support structure is configured to be disposed within openings of another support structure when the support structure is stacked onto the another support structure.

* * * * *